US005470031A

United States Patent [19]

Gagnon

[11] Patent Number: 5,470,031

[45] Date of Patent: Nov. 28, 1995

[54] REUSABLE WASTE MATRIX SLEEVE

[76] Inventor: Kevin Gagnon, 194 Jackson Rd., Richland, N.Y. 13144

[21] Appl. No.: 179,061

[22] Filed: Jan. 10, 1994

[51] Int. Cl.[6] ..... B65H 75/20

[52] U.S. Cl. ..... 242/571; 242/604

[58] Field of Search ..... 242/571, 572, 242/579, 600, 604, 604.1, 607, 607.1

[56] References Cited

U.S. PATENT DOCUMENTS

| | | | |
|---|---|---|---|
| 1,924,944 | 8/1933 | Kittredge | 242/604 |
| 2,095,594 | 10/1937 | Byron | 242/571 |
| 2,158,889 | 5/1939 | Annicq | 242/571 |
| 3,062,370 | 11/1962 | Morin | 242/571 |
| 3,152,692 | 10/1964 | Johnston | 242/604 |
| 3,460,360 | 8/1969 | Hashe, Jr. | 242/604 |
| 5,255,865 | 10/1993 | Buell et al. | 242/571 |
| 5,318,235 | 6/1994 | Sato | 242/571 |
| 5,335,872 | 8/1994 | Clubbs | 242/610.6 |

*Primary Examiner*—John P. Darling
*Attorney, Agent, or Firm*—Katherine McGuire

[57] ABSTRACT

A reusable wire mesh sleeve for removably mounting upon a drive spindle and being rotatable therewith. A roll of waste material forms on the rotating sleeve which may then be removed from the spindle. The sleeve is flexible such that it collapses upon itself when removed from the spindle whereby it is easily removable from the roll. The roll is then discarded minus a core which helps to reduce the amount of waste entering the landfill and/or incinerator. The sleeve is extremely durable such that it may be re-used indefinitely.

5 Claims, 3 Drawing Sheets

REUSABLE WASTE MATRIX SLEEVE

BACKGROUND OF THE INVENTION

The present invention relates to spindle sleeves and, more particularly, to a reusable and flexible spindle sleeve which is mounted upon a drive spindle and rotatable therewith. The roller sleeve is flexible such that it may accept a winding of material thereon when positioned on the spindle, and be removable from the spindle with the full roll of material wound thereon at which point it collapses upon itself whereupon it may be easily and quickly removed from the center opening of the roll.

In the label producing art, labels are typically cut from a continuous web of base material which has been wound into a roll. The roll is mounted upon a first spindle from which it is reeled and subjected to the label printing and cutting operations. As the labels are cut from the web of base material, a web of waste material (or "waste matrix", as it is referred to in the art) is created which is directed to a second spindle which winds it into a roll for easy disposal thereof. It is common practice in the art to use cardboard sleeves to serve as the core member for the roll of waste material. The cardboard sleeve is thus mounted upon the second spindle with the leading edge of the web of waste material attached thereto. As the second spindle rotates, the web of waste material winds itself upon the cardboard sleeve. Once fully wound, the roll of the waste material together with the cardboard sleeve is removed from the spindle. Since the cardboard sleeve is hence firmly secured within the core of the roll, the sleeve is discarded along with the roll which increases the amount of waste requiring disposal.

SUMMARY OF THE INVENTION

It is therefore a principal object of the present invention to provide a sleeve upon which a web of waste material may be wound which is easily removable from the resulting roll and is thus reusable.

It is a further object of the present invention to provide a sleeve of the above type which is flexible yet extremely durable.

It is another object of the present invention to provide a sleeve of the above type which is collapsible upon itself such that it may be removably mounted to a spindle whereupon a roll is wound thereon and, upon removal from the spindle, assume a form of reduced diameter for easy withdrawal from the core of the roll.

It is yet a further object of the present invention to provide a sleeve of the above type which contributes to the reduction of landfill waste.

Other objects will in part be obvious and in part appear hereinafter.

In accordance with the foregoing objects, the present invention comprises a cylindrical sleeve of wire mesh material formed from individual rows of interlocking wire coils. The sleeve is formed by joining opposite side edges of a rectangular or square length of the wire mesh material. This may be done by intertwining the individual coils located at the opposite side edges of the length of wire mesh material together by known manufacturing techniques (i.e., the same technique used to make the wire mesh material), or by placing the individual coils of the side edges in intersecting engagement with one another and inserting an elongated, rigid rod longitudinally therethrough thereby interlocking the side edges together to form the sleeve.

The flexible nature of the wire mesh material permits the sleeve to be freely movable between an expanded, maximum diameter condition, and a collapsed, minimum diameter condition. As such, the sleeve may be slid onto the free end of a drive spindle having a diameter slightly smaller than the maximum diameter of the sleeve in the expanded condition, with the sleeve being snugly fit in covering relation to the spindle. Also, a plurality of metallic rings are attached in annularly spaced relation about the edge of one end of the sleeve to assist in manual attachment and removal of the sleeve upon and from the spindle, respectively.

With the sleeve mounted upon the spindle as described above, the leading edge of the web of waste material is attached thereto. As labels are cut from a roll of base material, the web of waste material is drawn up by the spindle and wound upon the sleeve resulting in a roll of waste material being formed thereon. Once the label printing and cutting operations are finished, the sleeve and the roll of waste material are removed from the spindle. Once off the spindle, the sleeve automatically collapses upon itself whereupon it may be separated and removed from the waste material roll. The waste material roll is thereafter discarded and the sleeve is ready to be re-mounted to the spindle for subsequent use.

DETAILED DESCRIPTION

Figure 1:
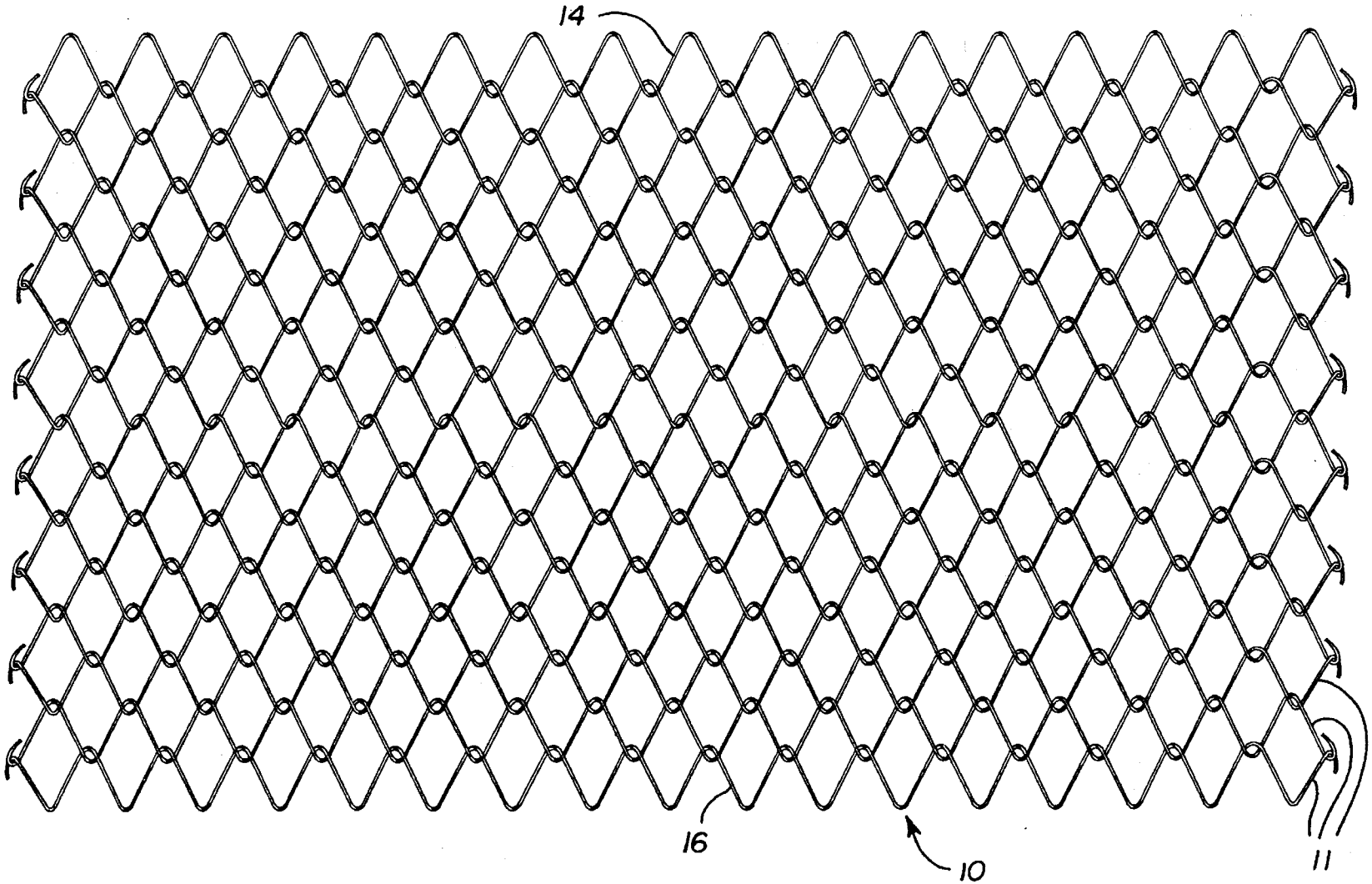
FIG. 1 is a plan view of a rectangular length of the wire mesh material from which the reusable sleeve is formed.
Figure 3:
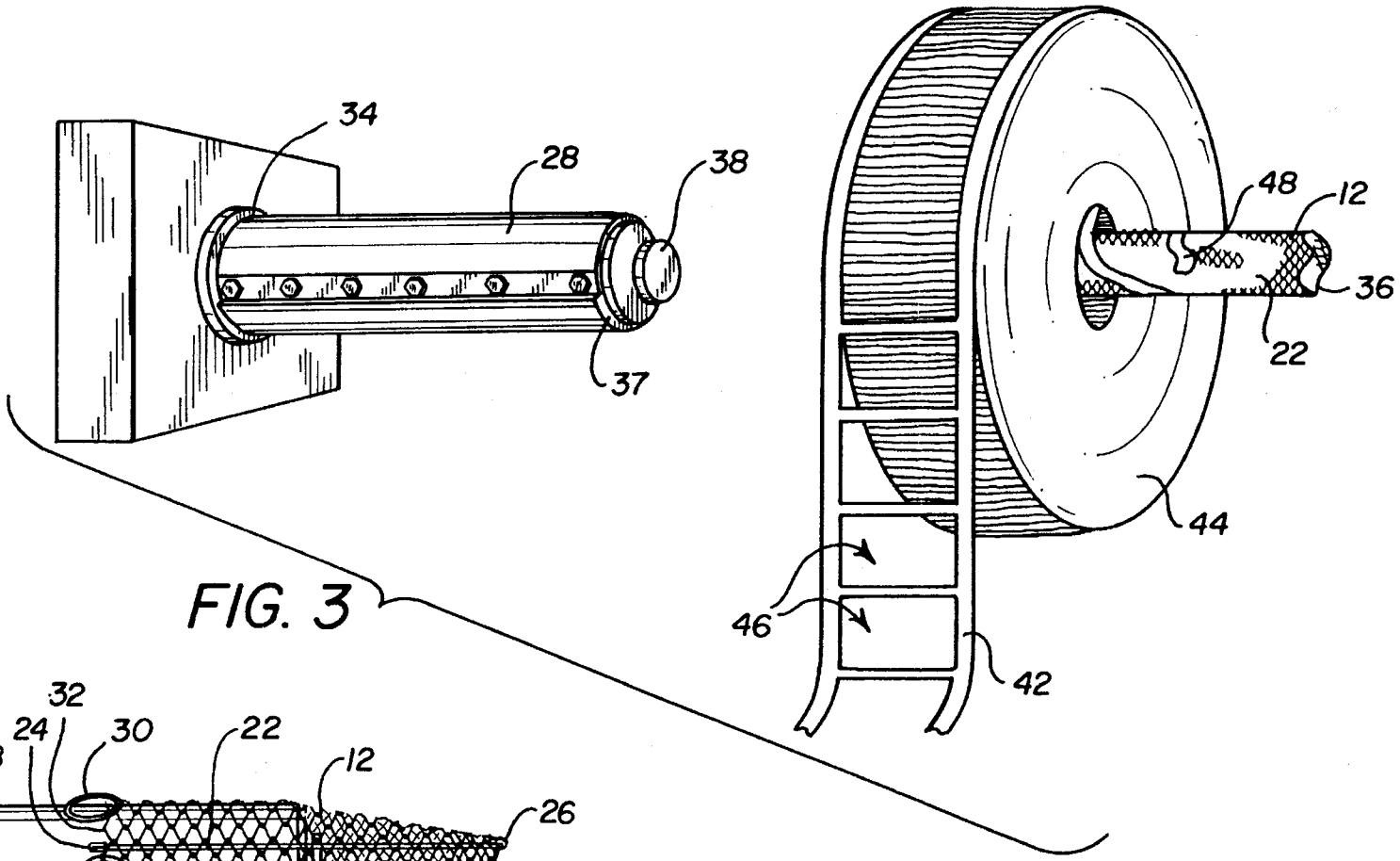
FIG. 3 is a perspective view of the spindle and a roll of label waste material removed therefrom with the sleeve shown collapsed and partially removed from the roll.
Figure 4:
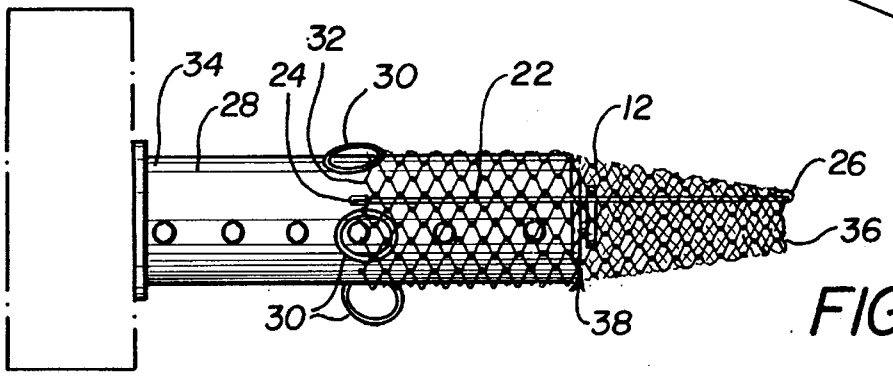
FIG. 4 is a side, elevational view of the sleeve shown partly on the spindle to emphasize the flexible nature of the sleeve.

Referring now to the drawing, there is seen in FIG. 1 a rectangular length of wire mesh material 10 which is formed from individual wire coils 11 which have been loosely intertwined together along their longitudinal lengths by known manufacturing techniques. Material 10 is thus flexible in nature yet extremely durable due to the rigidity of the individual metallic coils from which material 10 is formed. To form a sleeve such as sleeve 12 seen in FIGS. 2–4, the individual rows of coils 14 and 16 found along the opposite, longer sides of material 10 are placed in intersecting, meshing engagement with one another by known manufacturing techniques. Alternately, a rigid, elongated rod 22 is fed longitudinally through the intersecting coils 14 and 16 with the terminal ends 24 and 26 thereof being crimped back upon themselves as seen in FIGS. 2 and 4, thereby securing coils 14 and 16 together.

Due to the flexible nature of material 10, sleeve 12 may be freely moved between fully expanded and collapsed conditions. As seen in FIG. 4, sleeve 12 is half on and half off of a drive spindle 28. In this regard, sleeve 12 is provided with a plurality of metallic rings 30 attached in annularly spaced relation about open end 32 thereof. Rings 30 are provided to assist in manually mounting and removing sleeve 12 from spindle 28.

Spindle 28 is of a slightly smaller diameter than the maximum diameter of sleeve 12 when in the fully expanded condition. Thus, as open end 32 of sleeve 12 is fed over spindle 28, sleeve 12 assumes its fully expanded condition. The portion of sleeve 12 not on spindle 28 in FIG. 4 is partially collapsed since there is nothing supporting it in its expanded condition. It is thus appreciated that sleeve 12 will assume a collapsed condition of reduced diameter absent a central core (such as spindle 28) supporting it in the expanded condition.

Figure 2:
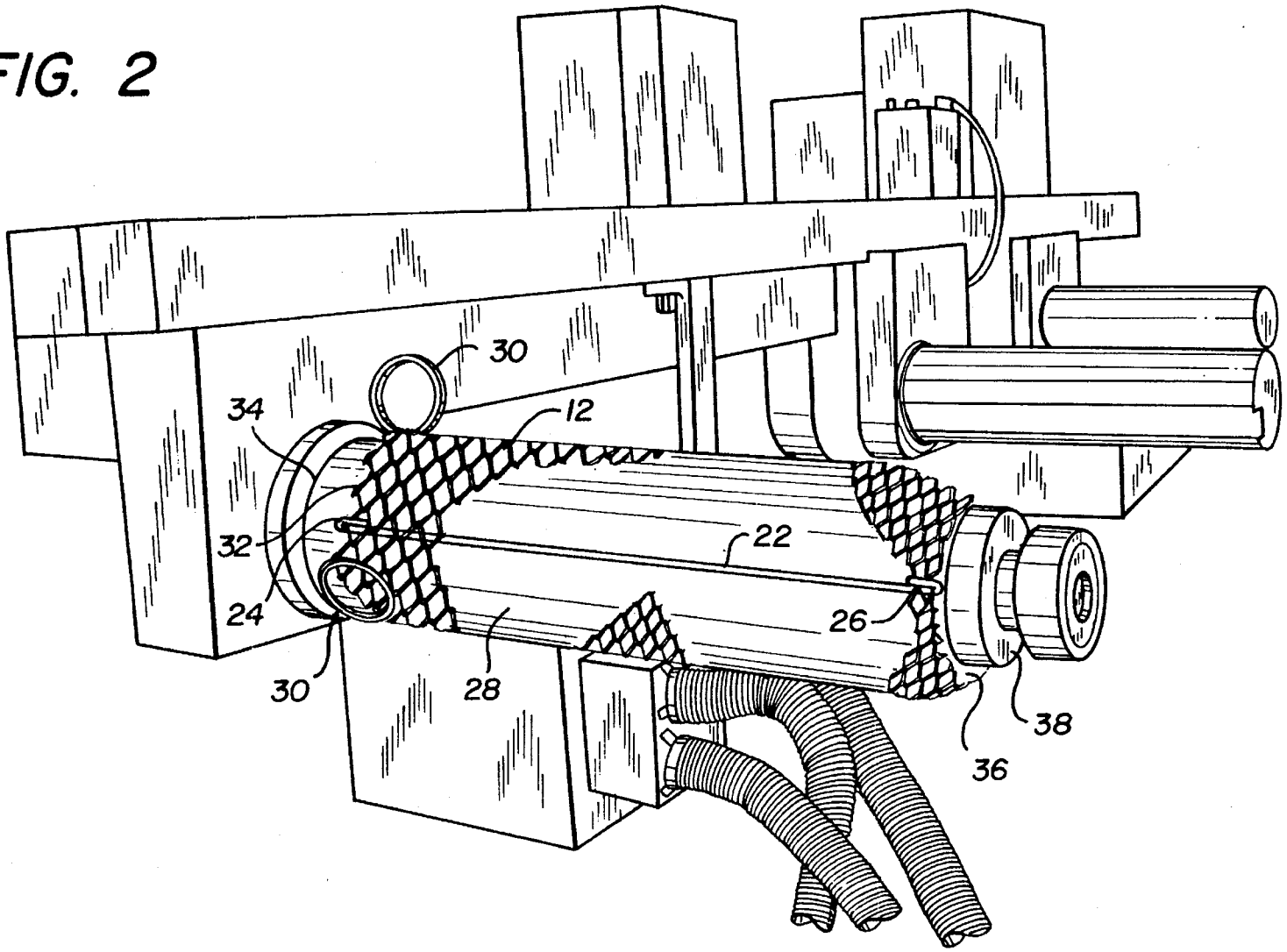
FIG. 2 is a perspective view of the sleeve mounted to a drive spindle in the intended manner with portions of the sleeve broken away to better reveal the rigid rod of the sleeve.

Sleeve 12 is thus positioned in concentric, covering relation upon spindle 28 as seen in FIG. 2 with sleeve open end 32 placed adjacent spindle mounted end 34, and opposite sleeve open end 36 placed adjacent spindle free end 38.

As mentioned previously, sleeve 12 is used as a core to receive a web 42 of label waste material thereon which is formed into a roll 44 as spindle 28 rotates. More particularly, a roll of label material is unwound from a first spindle and placed under printing and label-cutting operations (not shown). A web of waste material 42 remains having longitudinally spaced holes 46 from where the labels were cut. This waste material 42 is wound by drive spindle 28 into a roll 44 for ease of disposal. To begin a new waste roll, the leading edge 48 of the waste material web 42 is attached to sleeve 12 which has been mounted to spindle 28 in the manner described above. Leading edge 48 may be attached to sleeve 12 either by holding edge 48 while rotating spindle 28 a couple of turns to secure web 42 thereon, or by taping edge 48 to sleeve 12. As the web 42 of waste material exits from the printing and label-cutting apparatus, it is drawn up onto sleeve 12 by the rotation of spindle 28, resulting in a roll 44 of waste material. Roll 44 is removed from spindle 28 together with sleeve 12 at which point sleeve 12 collapses upon itself for easy removal from the center opening of roll 44 as seen in FIG. 3. The leading edge 48 of web 42 is detached from sleeve 12 whereupon roll 44 may be discarded with sleeve 12 free to use again upon spindle 28.

What is claimed is:

1. A reusable, flexible sleeve for removably mounting upon a drive spindle in concentric, covering relation thereto, said sleeve being rotatable by and with said spindle whereby said sleeve is adapted to receive and roll a web of waste material thereon upon rotation of said spindle and said sleeve, said sleeve comprising a length of flexible mesh material joined along opposite side edges thereof to form said sleeve with first and second, opposite, open ends, said sleeve being freely movable between a fully expanded, maximum diameter condition and collapsed, minimal diameter condition, said maximum diameter being slightly larger than the diameter of said spindle, said sleeve assuming said fully expanded condition upon mounting said sleeve to said drive spindle in concentric, covering relation thereto, said mesh material being formed from longitudinally interconnected, individual wire coils, said opposite edges of said mesh material are placed in removable, meshing engagement, and further comprising a rigid, elongated rod longitudinally extending through and securing said opposite side edges together.

2. The invention according to claim 1 and further comprising at least one rigid ring fixedly secured to one of said first and second open ends.

3. A reusable, flexible sleeve for removably mounting upon a drive spindle in concentric, covering relation thereto, said sleeve being rotatable by and with said spindle whereby said sleeve is adapted to receive and roll a web of waste material thereon upon rotation of said spindle and said sleeve, said sleeve comprising a length of flexible mesh material joined along opposite side edges thereof to form said sleeve with first and second, opposite, open ends, said sleeve being freely movable between a fully expanded, maximum diameter condition and collapsed, minimal diameter condition, said maximum diameter being slightly larger than the diameter of said spindle, said sleeve assuming said fully expanded condition upon mounting said sleeve to said drive spindle in concentric, covering relation thereto, said mesh material being formed from longitudinally interconnected individual wire coils, and further comprising at least one rigid ring fixedly secured to one of said first and second open ends.

4. The invention according to claim 3 and further comprising a plurality of said rigid rings fixedly secured in annularly spaced relation to said one of said first and second open ends.

5. The invention according to claim 3 wherein said opposite edges of said mesh material are placed in removable, meshing engagement, and further comprising a rigid, elongated rod longitudinally extending through and securing said opposite side edges together.

* * * * *